United States Patent [19]

Scheck et al.

[11] 4,385,773

[45] May 31, 1983

[54] SKI SAFETY BINDING

[75] Inventors: Georg Scheck; Ralf Storandt, both of Leonberg, Fed. Rep. of Germany

[73] Assignee: Geze GmbH, Leonberg, Fed. Rep. of Germany

[21] Appl. No.: 210,616

[22] Filed: Nov. 26, 1980

[30] Foreign Application Priority Data

Nov. 30, 1979 [DE] Fed. Rep. of Germany ..... 2948277

[51] Int. Cl.[3] ..... A63C 9/08

[52] U.S. Cl. ..... 280/612

[58] Field of Search ..... 280/611, 612, 618

[56] References Cited

U.S. PATENT DOCUMENTS

| | | | |
|---|---|---|---|
| 3,892,980 | 7/1975 | Anderson | 280/612 |
| 4,135,733 | 1/1979 | Salomon | 280/612 |
| 4,191,395 | 3/1980 | Salomon | 280/618 |
| 4,291,894 | 9/1981 | D'Antonio | 280/612 |

FOREIGN PATENT DOCUMENTS

| | | | |
|---|---|---|---|
| 2014935 | 10/1971 | Fed. Rep. of Germany . | |
| 2406015 | 8/1975 | Fed. Rep. of Germany . | |
| 2721691 | 11/1977 | Fed. Rep. of Germany . | |
| 2907939 | 9/1979 | Fed. Rep. of Germany . | |
| 2374922 | 8/1978 | France | 280/612 |

*Primary Examiner*—David M. Mitchell
*Assistant Examiner*—Kenneth R. Rice

[57] ABSTRACT

A ski safety binding is provided with a measuring system for determining the occurrence of a dangerous bending moment about a transverse axis 11 passing through the weakest point of the skier's leg lying generally somewhat above the ankle. In a first embodiment first, second and third measuring transducers 14, 15, 12 are strategically arranged between the sole of the ski boot and parts of a binding 33, 35 and the output signals from these measuring transducers are fed to a processing circuit 17 which computes the size of the bending moment about the transverse axis 11 and passes a release signal to an actuation device A to release the binding as soon as a dangerous level is reached. In a modification (FIG. 3) the ski boot is supported in the binding in such a manner that only two pressure measuring transducers are required. A variety of other embodiments are disclosed which show the use of ski bindings incorporating sole plates 24 (FIGS. 7, 8, 9, 10, 11 and 12) and various other arrangements of measuring transducers and processing circuits which enable the binding to be released both during forward and rearward falls and also on the occurrence of torsional loads.

29 Claims, 12 Drawing Figures

SKI SAFETY BINDING

Figure 1:
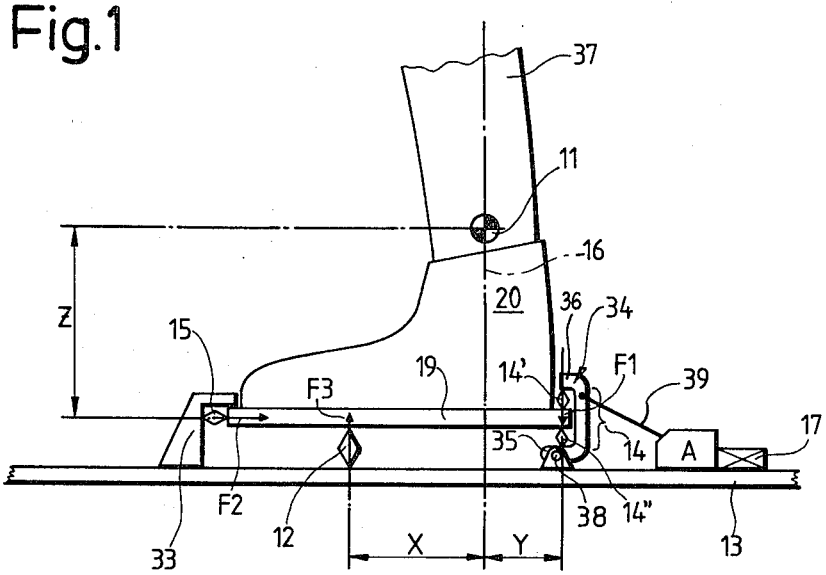

The invention relates to a ski safety binding with a measuring system for determining the occurrence of a dangerous bending moment at a skier's leg about a transverse axis lying between the ball and the heel of the skier's foot and spaced above the top of the ski and for forming a release signal when said dangerous bending moment is approached. The ski binding includes a ski boot securing system which is releasable by the operation of said release signal on actuation means of the boot securing system.

A ski safety binding of this kind which is equipped with two plates relatively movable to one another is already known in the art for example from DE-OS No. 23 24 078 and DE-OS No. 24 01 729. One of the two plates is fixedly mounted to the ski while the other is constructed as a sole plate which carries the boot retaining system and is pivotable about at least one transverse axis lying between the plates. As the release signal is formed in dependence on the torque about the transverse axis lying between the plates the release signal does not correspond in the desired manner to the dangerous bending moment which can be exerted on the skier's leg. The weakest point of the skier's leg which has to be protected from excessive moments and which thus corresponds to the point at which the bending moment exerted on the skier's leg should be measured lies namely preferably in the region of the upper edge of the boot upper or just inside the boot. That is to say ski boots are conventionally designed so that they extend up the leg to a position at or just above the weakest point of the skier's leg. In the longitudinal direction of the ski this weakest point is located between the ball and the heel of the ski boot and is preferably located midway between the ball and the heel regions. In the vertical direction the position of the point at which the bending moment (which operates about a transverse axis on the skier's leg) is measured can also lie significantly above the upper edge of the boot upper. In general the preferred position of the transverse axis about the which the bending moment is measured can be taken to be somewhere above the ankle.

The principal object underlying the invention is thus to provide a ski safety binding of the initially named kind by means of which a release signal for the boot securing system can be formed which is direct measure of the bending moment acting on the leg of the skier at a predetermined position. This position is preferably the weakest part of the skier's leg and the difficulty of carrying out such a measurement resides in the fact that the measurement at the location of the relevant transverse axis itself cannot be entertained for practical reasons.

In order to accomplish this object a first embodiment of the invention is characterized by a first measuring transducer arranged between the ski and the sole of the ski boot at a distance in the longitudinal direction of the ski behind the transverse axis for measuring the force transmitted at this distance to the sole of the ski boot, and preferably the force transmitted in a downward direction; a second measuring transducer arranged between the ski and the sole of the ski boot and operative in the longitudinal direction of the ski to measure the force operating in this direction on the sole of the ski boot, and preferably the force transmitted in the forward direction; and a third measuring transducer arranged between the ski and the sole of the ski boot at a distance in the longitudinal direction of the ski in front of the transverse axis for measuring the force transmitted at this distance to the sole of the ski boot, and preferably the force transmitted in an upward direction and wherein output signals of the first, second and third measuring transducers are applied to a processing circuit which forms the release signal taking account of the said output signals. The evaluation is particularly simplified when the two horizontal distances of the first and third measuring transducers from the transverse axis are the same. In this case the processing can take place simply by arranging the processing circuit to form the sum of the signals formed by the third and first measuring transducers reduced by the output signal of the second measuring transducer multiplied by a factor directly proportional to the distance of the transverse axis from the point of support of the sole of the ski boot on the third measuring transducer and inversely proportional to the distance of the support point from the vertical transverse plane which extends through the transverse axis.

A further simplification is possible by the omission of the third measuring transducer and its replacement by a support part mounted on the ski which allows a small degree of tilting of the binding at least about a transverse axis lying in the region of the lower side of the sole of the ski boot. In this case the output signals of the two remaining measuring transducers are applied to a processing circuit which forms a release signal taking account of the output signals of the first and second measuring transducers. With this arrangement the processing circuit is advantageously arranged to form the release signal from the output signal of the first measuring transducer reduced by the output signal of the second measuring transducer multiplied by a factor directly proportional to the distance of the transverse axis from the point of pivotal support of the sole of the ski boot and inversely proportional to the distance of the first measuring transducer from the transverse vertical plane through the transverse axis.

Thus either two or three forces which act between the ski boot and the ski are measured at special points of the binding selected in accordance with the present teaching. By superimposing the signals arriving from either the two or the three measuring transmitters in accordance with the invention a value results which is a direct measure of the moment operating on the skier's leg about the critical transverse axis. The invention thus provides a measuring system for determining the occurrence of a dangerous bending moment at a position significantly above the sole of the ski boot using very simple constructional means.

Thus, in accordance with the invention, it is not necessary to arrange components in the region of the critical axis itself in order to carry out the required measurement. All the constructional elements necessary to realize the thought underlying the invention can be arranged beneath, in front of, behind or fractionally above the sole of the ski boot. Thus, although the binding measures a bending moment which occurs significantly above the sole of the ski boot it is not distinguished in its external appearance and basic arrangement from other customary ski bindings. Known ski bindings only require to be equipped with measuring transducers and in other respects to be so constructed that the measuring transducers are able to determine either the two or the three forces that are required as acccurately as possible in order to make use of the present teaching.

It is of particular significance that, of the force signals which are to be collected together in a linear combination, the force signal operating in the longitudinal direction of the ski is amplified by a constant which depends on the type of binding.

The release signal of the present invention can be derived, on taking into account the above defined instructions, for any desired position of the transverse axis above the plate and between the ball and heel of the skier's foot. In particular the release signal can be derived for a transverse axis located in the vicinity of the center of the leg portion of the ski boot.

The choice of the correct sign for the forces measured by the measuring transducers is essential to achieve the correct release signal. If one considers a ski boot arranged in a ski safety binding equipped with three measuring transducers in accordance with the present teaching then the output signals of the three measuring transducers must be positive when the reaction force exerted by the first measuring transducer on the ski boot produces a rearward torque, when the reaction force exerted by the second measuring transducer on the ski boot exerts a forward torque and when the force exerted on the ski boot by the third measuring transducer once again produces a rearward torque with the torques being referred to the transverse axis which passes through the most endangered zone of the leg in the region of the upper edge of the ski boot.

In the embodiment of the ski safety binding which operates with only two measuring transducers the output signals are positive when the force exerted by the first measuring transducer on the ski boot produces a rearward torque and the force exerted by the second measuring transducer on the ski boot produces a forward torque with reference to the transverse axis passing through the endangered section.

Both embodiments of the invention can be used for bindings both with and without sole plates. If the invention is used in connection with a binding without a sole plate then one generally only uses pressure measuring transducers arranged between the sole of the ski boot and the ski or parts of the binding because the transmission of tensile forces between the sole of the ski boot and the measuring transducers would require special constructional features of the ski boot which is generally undesirable.

In the embodiment utilizing three measuring transducers, the first measuring transducer arranged in the heel region, under certain circumstances, not only has to transmit forces acting downwardly on the sole of the ski boot but also, for steeply downwardly directed resultant forces, has "forces acting upwardly thereon. For this reason it is advantageous"; for the first measuring transducer to be divided into two pressure measuring transducers for the forces which act downwardly and upwardly on the sole of the ski boot and for the output signals of the pressure measuring transducer for the upwardly directed force to be provided with a negative sign prior to the addition. In this way premature opening of the binding when the resultant force is directed behind the third measuring transducer through the ski is avoided.

A significant aspect of the invention is the determination of the force acting on the sole of the ski boot in the longitudinal direction of the ski, in particular from front to rear and its linear combination with the other forces in the sense of the invention. In order to determine this force the second measuring transducer, which takes the form of a pressure transducer, can be arranged between the front end of the sole of the ski boot and a toe unit of the binding. The measurement of this force can however also be carried out by attaching one or more strain gauges at suitable points on the toe unit.

The first measuring transducer, which takes the form of a pressure transducer for the downwardly transmitted force, is preferably arranged between the upper side of the sole at the heel and a sole restraining member which is preferably arranged on a rearwardly pivotable sole clamp. In this arrangement strain gauges on the sole clamp can also be used for the first measuring transducer. As the first measuring transducer, or the components which transmit the force to the first measuring transducer, engage over the sole of the ski boot it is important that the release signal is effective to pivot the sole clamp rearwardly or to the side away from the sole of the ski boot when the critical value is exceeded.

If, in an embodiment using three measuring transducers, it is also desired to detect the force acting upwardly on the heel then the partial measuring transducer for the upwardly transmitted force is arranged between the lower side of the ski and a pedal member of the sole clamp. In this embodiment strain gauges can once again be used to measure the forces transmitted downwardly to the pedal and thus to fulfill the role of partial measuring transducers.

In the case of an embodiment using only two measuring transducers the first measuring transducer can also be arranged at the same distance in front of the transverse axis between the ski and the sole of the ski boot. This arrangement thus also saves the necessity for parts carrying the measuring transducer to overlap the sole of the ski boot.

In an embodiment of the invention using only two transducers a release signal can also be generated in the event of a rearward fall using an analogous arrangement of further first and second transducers.

The invention can be particularly advantageously put into use if at least one sole plate is inserted between the sole of the ski boot and the measuring transducers. In this arrangement the sole plate is preferably fixedly connected to the ski via the measuring transducers and carries the boot retaining system. In this case the measuring transducers can be fixedly integrated into the sole plate so that they are completely encapsulated and protected from the external environment. It is particularly advantageous when using a sole plate that the measuring transducers do not have to be arranged on the boot retaining system. This is of important significance because electric lines have to be led from the measuring transducers to the processing circuit. As the processing circuit and the actuation means for releasing the boot retaining system can also be arranged on the sole plate, all the electronic components and connecting elements can be assembled in or on the sole plate at the outset. The sole plate then only needs to be connected, together with the components retained therein, or thereon, to the ski.

In an embodiment equipped with two measuring transducers it is useful, when using a sole plate, for the sole plate to be pivotally mounted on the ski in the region of the point of pivotal support of the ski boot and about the associated transverse axis. The plate is thus pivotable about a transverse axis in the region of the bottom side of the plate and beneath the critical transverse axis so that only the first measuring transducer need be used to completely stabilize the plate relative to the ski. It is however necessary to ensure that the plate has a sufficient freedom of movement in the longitudinal direction of the ski that the second measuring transducer, which determines the force in this direction, is subjected to the force necessary to allow an accurate measurement.

A continuous or one piece sole plate is preferably provided which extends beneath the sole of the ski boot at least in the region of the measuring transducers. The sole of the ski boot is preferably supported by the sole plate over its whole length and width.

It is however also possible to provide two separate sole plates with the front sole plate being associated with the third measuring transducer, if provided, and with the rear sole plate being associated with the first measuring transducer. The second measuring transducer which determines the force in the longitudinal direction of the ski can be associated with either the first or the second sole plate. Once more care must be taken to ensure a suitable degree of play for the relevant plate in the longitudinal direction of the ski.

The use of a sole plate has shown itself to be particularly advantageous when at least one of the measuring transducers, and preferably all the measuring transducers, take the form of push-pull measuring transducers. If measuring transducers of this kind are arranged between the sole plate and the ski, so that they provide an electrical output signal when loaded both in tension and under pressure with a correspondingly changed sign, then the following advantages and possibilities are achieved for the various embodiments.

For the first embodiment, in the event that only a forward fall is to be considered, only the first measuring transducer needs to be constructed as a push-pull transducer in order to be able to deliver a negative output signal when the resultant force is directed through the ski behind the third measuring transducer. A special measuring transducer for detecting this tensile force is thus rendered necessary.

If the other two measuring transducers are also constructed as push-pull transducers the output signals can be arranged, by the use of appropriate circuitry, to produce a release signal also in the event of a rearward fall. In advantageous manner the constants to be taken into account for the rearward fall can be selected differently from those for the case of the forward fall.

The construction of the measuring transducers for the second embodiment as push-pull transducers also offers the advantage that a release signal can be generated in the event of a backward fall.

In the case of the particularly advantageous embodiment with a one piece sole plate, the sole plate is advantageously also arranged to be pivotable to a small degree to both sides of the ski against spring force about a vertical axis extending through the transverse axis. The boot retaining system can also be released in the event of pivotal movement of this kind. The sole plate can thus also be used to release the ski boot in the event of a torsional load as well as releasing it in the event of a forward or backward fall.

Figure 2:
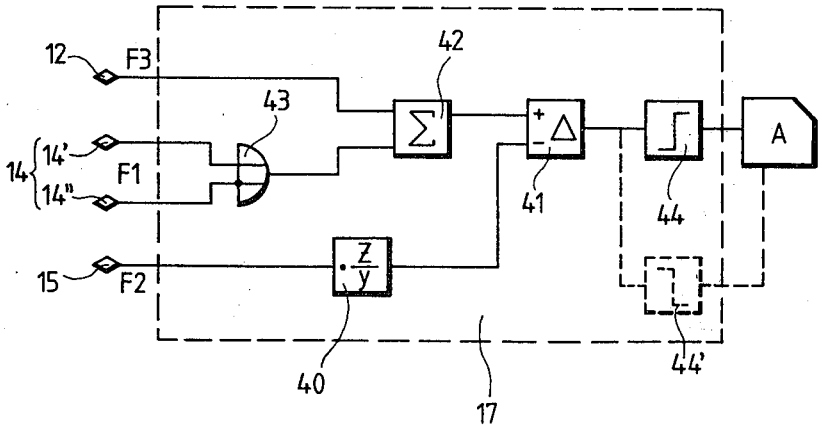
Figure 3:
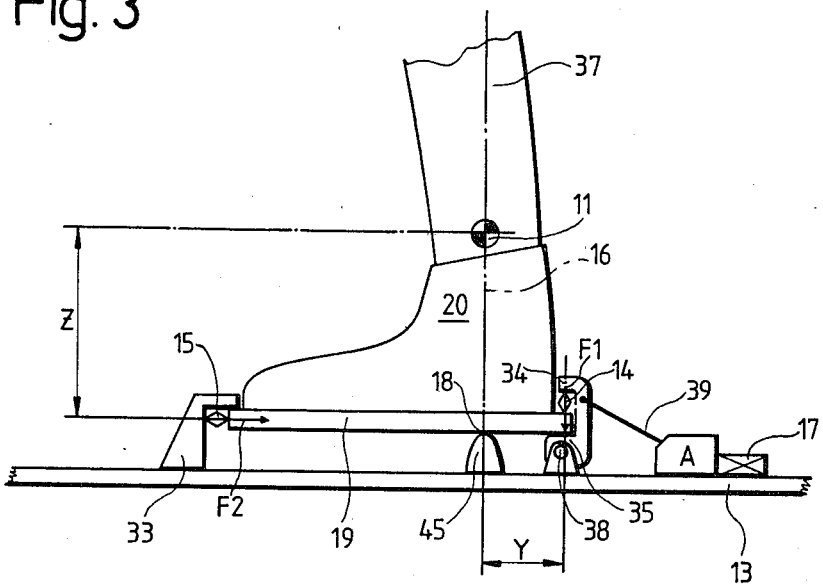
Figure 4:
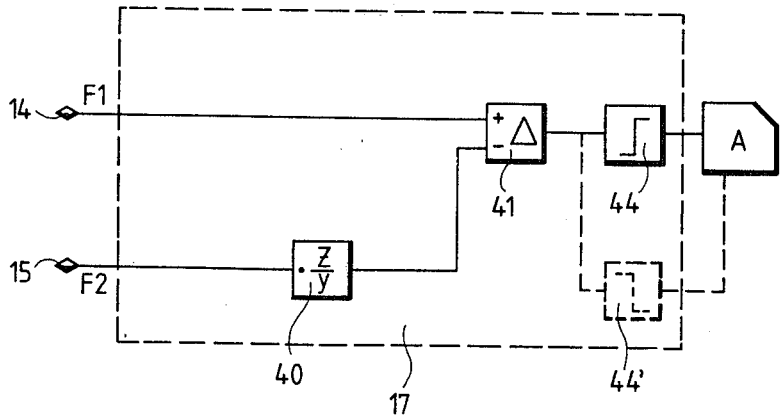
Figure 5:
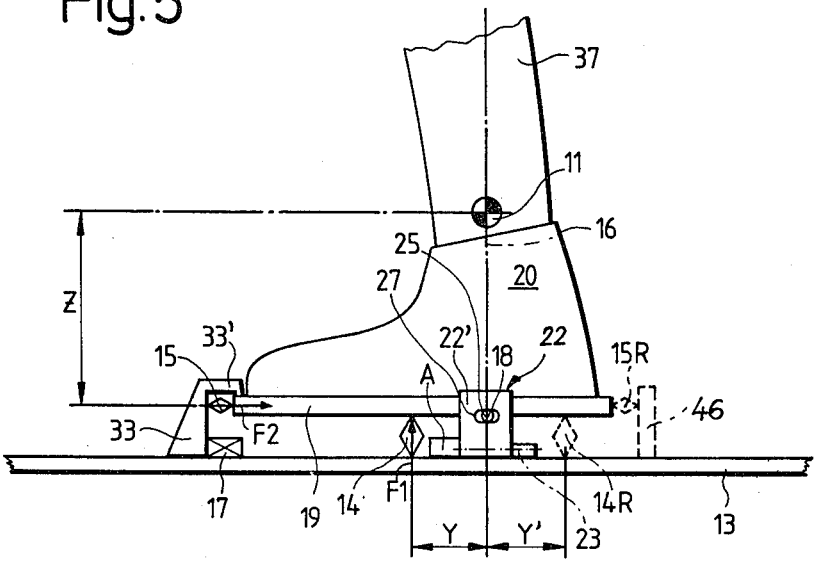
Figure 6:
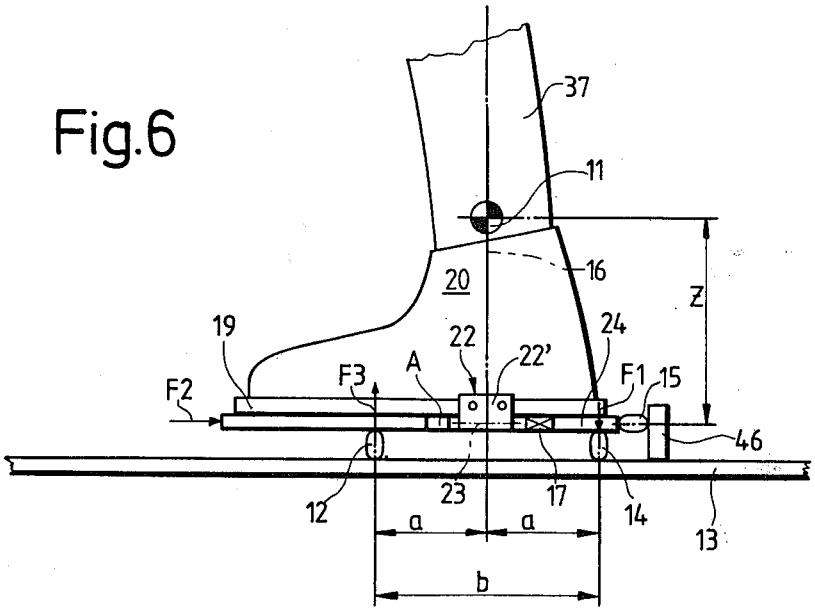
Figure 7:
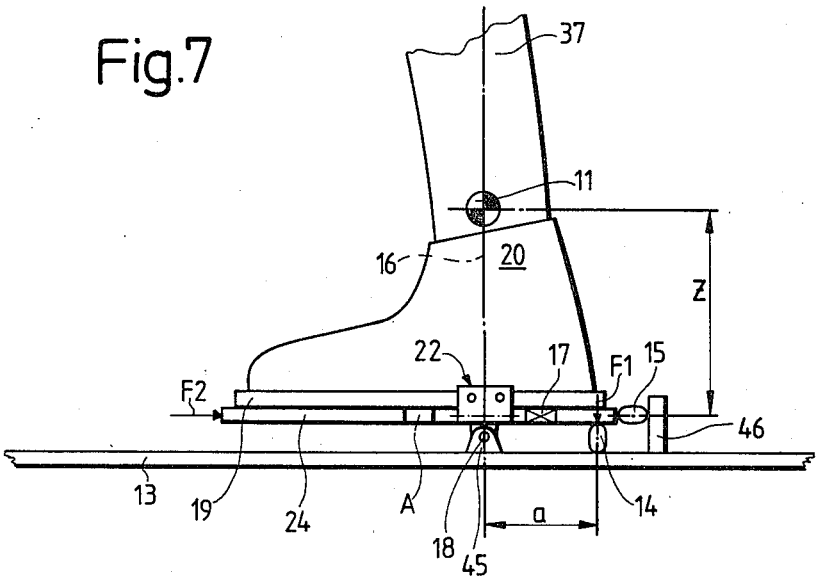
Figure 8:
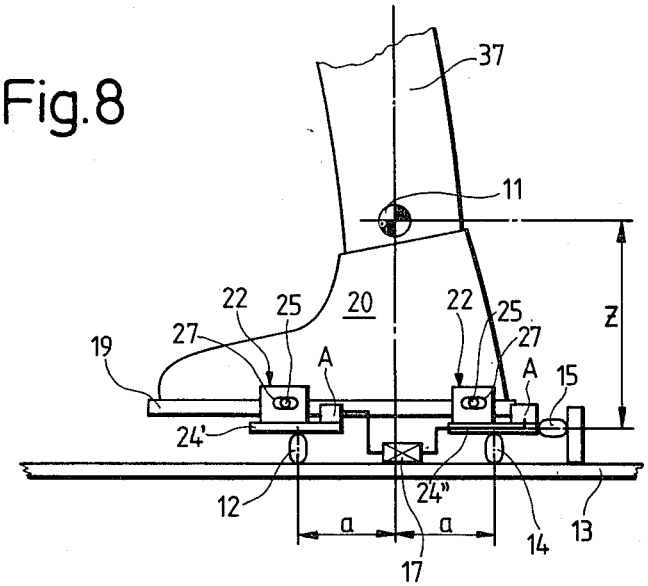
Figure 9:
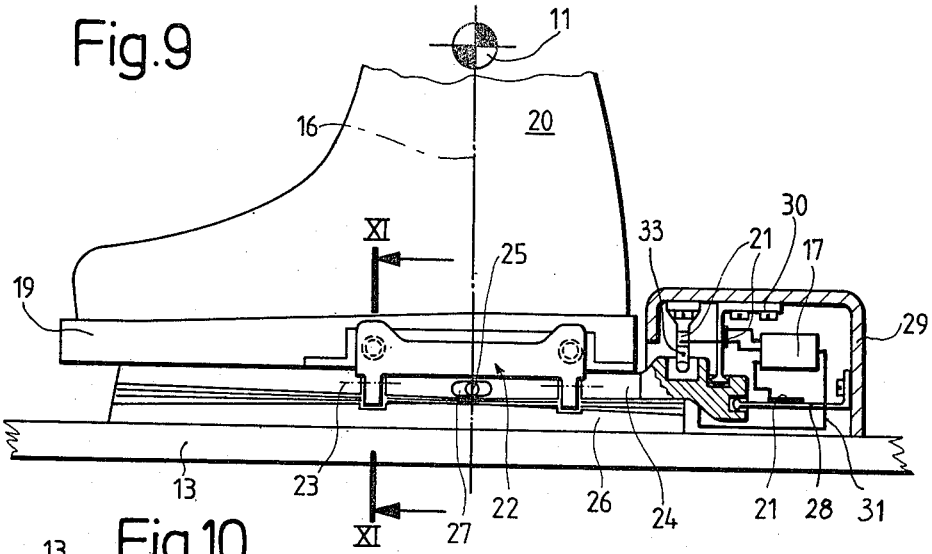
Figure 10:
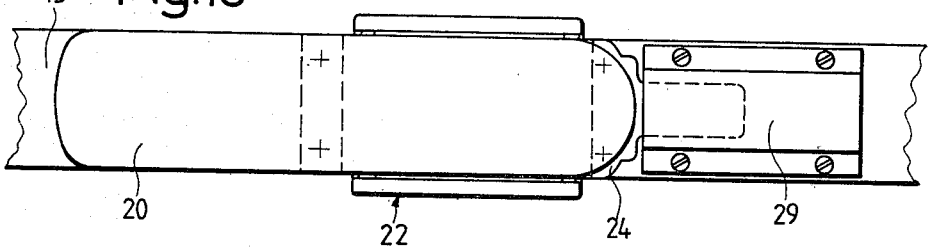
Figure 11:
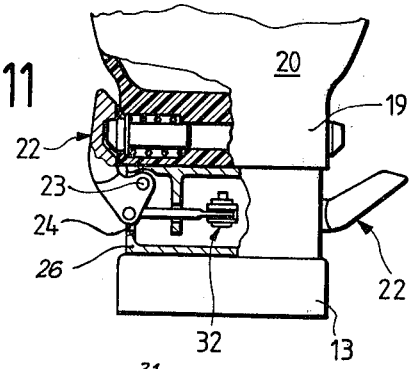
Figure 12:
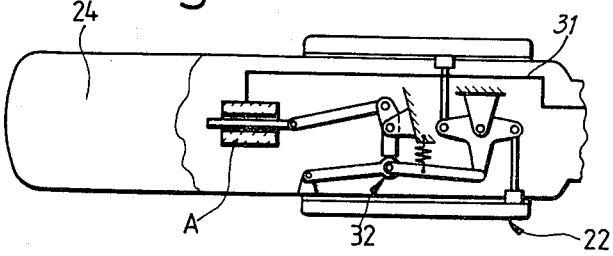

The invention will now be described in more detail by way of example only and with reference to the drawings which are of a purely schematic nature and which show:

FIG. 1 a schematic side view of a first embodiment of a ski safety binding in accordance with the present teaching and showing a ski boot engaged in the binding, FIG. 2 a block circuit diagram of a processing circuit which can be used with the embodiment of FIG. 1, FIG. 3 a side view similar to that of FIG. 1 of a simplified embodiment of the invention, FIG. 4 a block circuit diagram of a processing circuit which can be used with the embodiment of FIG. 3, FIG. 5 a variant of the embodiment of FIG. 3, FIG. 6 a side view of a modification of the first embodiment of the invention using a sole plate, FIG. 7 a side view of a simplified embodiment of the invention incorporating with a sole plate, FIG. 8 a variant of the embodiment of FIG. 6 showing a sole plate divided into two parts, FIG. 9 a partially sectioned side view of a practical embodiment of the binding schematically illustrated in FIG. 6, FIG. 10 a plan view of the binding of FIG. 9, FIG. 11 a section on the line XI—XI of FIG. 9 and FIG. 12 a plan view of the release mechanism of the binding of FIGS. 9 to 11.

As seen in FIG. 1 a toe unit 33 and a heel clamp 34 pivotable about a transverse axis 38 are mounted on a ski 13. The heel clamp 34 is connected by a rod 39 to an actuation device A which is operative to move the heel clamp 34 from the closed position illustrated in the drawing to a rearwardly pivoted open position on receipt of a release signal from a processing circuit 17 which will be later described in more detail. A ski boot is mounted by its sole 19 between the toe unit 33 and the heel unit 34 of the binding. The skier's leg 37 is illustrated in schematic fashion protruding from the ski boot. The section of the skier's leg 37 which is particularly in danger of breaking is assumed in this case to lie somewhat above the upper edge of the ski boot and in the longitudinal direction of the ski approximately in the center between the forward and rear edges of the leg portion of the ski boot on the transverse axis 11. The torque present about this transverse axis 11 is the determining factor for the load on the skier's leg 37 and cannot be allowed to exceed a predetermined value. The perpendicular distance of the endangered section of the skier's leg, i.e. of the transverse axis 11 from the line of action of a force F2 generated at the toe unit is designated by the reference numeral Z.

A pressure measuring transducer 15, hereinafter referred to as the second measuring transducer is arranged between the front end of the sole 19 of the ski boot and the contact point on the toe unit 33 and is schematically illustrated as a rhombus. The rearwardly directed force F2 is transmitted via the second measuring transducer to the sole 19. A further pressure transducer 12, hereinafter referred to as the third measuring transducer, which exerts an upwardly directed holding force F3 on the sole 19 is located beneath the sole 19 at a distance x in front of the vertical transverse plane 16 which extends through the transverse axis 11.

Finally, an additional pressure transducer 14, hereinafter referred to as the first measuring transducer and in this embodiment consisting of first and second pressure transducing elements 14', 14'', is arranged at the rear of the ski boot to detect the downwardly directed force F1 exerted from the sole retaining member 36 of the sole clamp 34 on the sole 19. The particular arrangement features the pressure transducing element 14' which is arranged between the sole retaining member 36 on the heel clamp 34 and the upper side of the sole 19 to determine the downwardly directed force F1 and the further pressure sensing element 14'' arranged between the underside of the sole 19 and the pedal member 35 of the heel clamp 34. The further pressure sensing element 14'' detects the force transmitted upwardly to the sole 19 in the heel region. The two pressure sensing elements 14', 14'' have a horizontal distance y from the vertical transverse plane 16. The horizontal distance of the third measuring transducer 12 from the first measuring transducer 14, i.e. from the first and second pressure sensing elements 14', 14'' is accordingly X+Y.

In accordance with the present teaching a release signal S is formed from the signals of the first, second and third measuring transducers in accordance with the following equation:

$$S=F1.Y+F3.X-F2.Z \quad (1)$$

In normalized form the release signal S is simplified as follows:

$$Sn=F1+F3\cdot X/Y-F2\cdot Z/Y \quad (2)$$

These conditions can be varied within a certain range of tolerances without leading to significant error in the measurement of the torque or bending moment about the transverse axis 11.

FIG. 2 illustrates the manner in which the signals derived from the first, second and third measuring transducers 12, 14, 15 are processed in the processing circuit 17 in order to form the release signal Sn for the actuation device A. To simplify the equation it is assumed that X=Y so that the release signal Sn has the form given below:

$$Sn=F1+F3-F2\cdot Z/Y \quad (3)$$

As shown in FIG. 2 the signal of the third measuring transducer which corresponds to the force F2 is applied via a multiplication stage 40, in which the force signal F2 is multiplied by the factor Z/Y, to the minus input of a difference forming stage 41. The signal output of the first measuring transducer 12 arranged in the ball region of the sole of the ski boot is applied to one input of a summing stage 42. A second input of the summing stage 42 is fed from an OR gate 43 with the output signals of the pressure transducing elements 14', 14'' being applied to respective inputs of the OR gate 43. A point at one input of the OR gate 43 signifies that the output signal of the pressure transducing element 14'' is negated. As, at any one time, an output signal can only be present at one of the two pressure sensing elements 14', 14'' the corresponding input of the summing stage 42 either receives a positive signal F1 from the pressure sensing element 14' or a negative signal F1 from the pressure sensing element 14'', with the absolute size of the signals depending, as for the other measuring transducers, on the prevailing level of the measured force.

The output of the summing stage 42 is applied to the plus input of the difference forming stage 41. A threshold circuit 44 follows the difference forming stage 41 and only passes the release signal Sn to the actuation device A when it lies above a predetermined threshold corresponding to the danger of breakage of the skier's leg.

The processing circuit 17 of FIGS. 1 and 2 thus first of all multiplies the signal representing the force F2 acting in the longitudinal direction of the ski by the factor Z/Y which, for customary bindings, lies around 1,4. This value represents a constant which is determined by the geometry of the binding and which can lie between 1 and 4 depending on the position at which the forces are measured relative to the ski boot.

The signs of the forces given in the equations 1, 2 and 3 can be seen from the arrows of FIG. 1 which point in the positive force directions. Accordingly the sign of the force F1 ist inverted when a signal is produced only by the pressure sensing element 14'' and not by the pressure sensing element 14'. The threshold of the threshold circuit 44 is so adjusted that, as soon as a predetermined value corresponding to the dangerous bending moment at the axis 11 on the skier's leg 37 is exceeded, the actuation device A opens the heel binding 34 and thus releases the ski boot.

The block circuit diagram of FIG. 2 should be regarded as purely schematic. Intermediate amplifiers at individual parts of the circuit and also the power supply are, for example, not illustrated.

The same reference numerals are used in FIG. 3 as in the remaining figures to designate parts which correspond with those shown in FIG. 1.

FIG. 3 shows a further simplified embodiment in which the distance x=0 so that the first measuring transducer 12 for the force F3 can be omitted. To realize this embodiment the third measuring transducer 12 must however be replaced by a ski mounted support part 45 which permits a small degree of tilting about a transverse axis 18 lying in the region of the lower side of the sole 19 of the ski boot. The release formula (2) thus simplifies to:

$$Sn=F1-F2\cdot z/y \quad (4)$$

In addition the lower pressure measuring transducer 14'' of FIG. 1 is also omitted. In this region the sole of the ski boot lies directly on the pedal 35.

The embodiment of FIG. 3 makes it possible to use a considerably simplified processing circuit 17 of the form schematically illustrated in FIG. 4. The electrical output signal of the heel pressure measuring transducer 14 is applied directly to the plus input of the difference forming stage 21, if necessary after suitable amplification. The signal from the pressure measuring transducer 14 for the force F2 acting in the longitudinal direction is multiplied in the multiplication stage 40 by the factor z/y and is then applied to the minus input of the difference forming stage 41. The output of the difference forming stage 41 is again applied to the threshold circuit 44 which feeds the actuation device A to open the binding as soon as the release signal Sn exceeds a predetermined critical value. In the second simplified basic embodiment of the invention shown in FIGS. 3 and 4 the signal for the longitudinal force F2 is first multiplied in the processing circuit 17 by the factor z/y. The product signal F2·z/y is then subtracted from the force signal F1. This net release signal then controls the actuation device A via the processing circuit 44 with the actuation device A causing the heel clamp 34 to open by way of the rod 39 as soon as a preset threshold is exceeded.

FIG. 5 shows a modification of the embodiment of FIG. 3. In place of a heel clamp the binding here is provided with a boot retaining system 22 having two clamps 22' which are pivotable in a sideways direction about longitudinal axes 23. The side clamps 22' have elongate slots 27 which extend in the longitudinal direction of the ski and side journals 25 provided on the ski boot engage in these slots. The elongate slots 27 allow a small degree of play of the ski boot 20 in the longitudinal direction of the ski.

In contrast to the embodiment of FIG. 3 the first measuring transducer 14 is arranged at a distance y in front of the vertical transverse plane 16 extending through the transverse axis 11. This does not however produce a change with regard to the output signal of the pressure measuring transducer 14 because on pivoting of the ski boot 20 about the journals 25 which lie in the transverse plane 16 the same force F1 will be generated at the pressure measuring sensor 14 as for the similarly designated pressure measuring transducer in FIG. 3. The second pressure measuring transducer 15 for the longitudinal force F2 is arranged in accordance with the embodiment of FIG. 3 so that the processing circuit for this embodiment is also constructed in the same way as is shown in FIG. 4. The processing circuit 17 once again feeds an actuation device A which is able to pivot the side clamps 22' of the boot retaining system 22 away from the boot in a sideways direction and thus to release the ski boot.

In the way that the embodiment of FIG. 5 has been hitherto described it is necessary to provide a part 33' at the toe unit 33 which overlaps the front edge of the ski boot in order to prevent the sole 19 tilting in a rearward direction. The projection 33' can however be omitted if a further pressure measuring transducer 14R which is illustrated only in broken lines in FIG. 5 is positioned between the sole 19 of the ski boot and the ski at a distance y' behind the transverse plane 16 and if, in addition, a pressure measuring transducer 15R is present between the rear edge of the sole 19 and a ski mounted block 46 with the pressure measuring transducer 15R producing an output signal corresponding to the longitudinal force exerted on the sole of the ski shoe from the rear. If the further pressure measuring transducers 14R, 15R are connected analogously to the pressure measuring transducers 14, 15 in FIG. 4 and if this further processing circuit is also correspondingly applied to the actuation device A then the binding can also release during a backward fall as soon as the critical release value is exceeded. It is particularly significant that for backward falls both constants i.e. y' and eventually also z can be selected to be different from the values used for a forward fall should this turn out to be appropriate for anatomical reasons.

FIG. 6 shows an embodiment analogous to that of FIGS. 1 and 2 with a sole plate 24 inserted between the sole 19 of the ski boot and the measuring transducers 12, 14, 15. The sole plate 24 can be regarded for the purpose of the explanations given in connection with the embodiment of FIGS. 1 and 2 as the actual sole of the ski boot. The measuring transducers 12, 14, 15 act however not on the sole 19 of the ski boot but instead on the sole plate 24.

In the embodiment of FIG. 6 the ski boot 20 is secured on the sole plate 24 by a boot retaining system 22 having two side clamps 22' which are pivotable away from the boot in a sideways direction.

The actuating device A and the processing circuit 17 are also located at the sole plate 24. It is also posssible to use any other boot retaining system which can be opened by the actuation device A.

In contrast to the embodiment of FIGS. 1 and 2 the embodiment of FIG. 6 uses push-pull measuring transducers 12, 14, 15 which are illustrated as ellipses and should be imagined as being fixedly connected with the ski 13 and the sole plate 24 so that they can hold the sole plate to the ski against forces occurring in any direction.

In the embodiment of FIG. 6 the circuit of FIG. 2 should be modified so that only the one push-pull measuring transducer 14 is applied to the second input of the summing stage 42 in place of the two pressure transducing elements 14', 14''. The push-pull pressure transducer 14 is then in the position of being able to generate both a positive pressure signal F1 and also a negative tension signal.

If the embodiment of FIG. 6 is also to be arranged for release during a rearward fall the output signal of the difference forming stage of FIG. 2 could, by way of example, be passed in the manner indicated in broken lines to a further threshold circuit 44' with a threshold the sign of which is reversed relative to that of the circuit 44 and which likewise controls the actuation device A. As, during a rearward fall all the signs of the formula 1 given on page 16 reverse the initiation of the actuation device A can also take place during a rearward fall as a result of the correspondingly constructed threshold circuit 44'.

It is of particular significance, when using a sole plate 24 which is rigidly connected to the sole 19, that all the electronic and mechanical components can be arranged in or on the sole plate 24 so that all the binding parts can be fully assembled in the factory. It is then only necessary to fasten the plate constructed in this way to the ski.

FIG. 7 shows a simplified version of the embodiment of FIGS. 3 to 5 using a sole plate 24. In this case the sole plate 24 is intended to be pivotally mounted at the support pivot point 18, i.e. non-releasably mounted on the bearing block 45 which is attached to the ski 13, so that the sole plate can only pivot about the axis 18 but cannot be removed from the ski. The two measuring transducers 14, 15 are once again arranged in the illustrated manner at the heel region. The pivotal support at 18 must be such that the push-pull transducer 15 can be loaded as a result of a small degree of play of the plate 24 in the longitudinal direction.

The measuring transducers 14, 15 of this embodiment are also constructed as push-pull transducers and are so connected with the ski 13 the sole plate 14 and the block 46 that both pressure and tensile forces can be transmitted between the plate 24 and the measuring transducers 14, 15.

In the embodiment of FIG. 7 care should be taken to ensure that the output signals of the measuring transducers 14, 15 are positive when a tensile force is exerted thereon. This can also be achieved by suitably reversing the signal in the processing circuit 17.

By building in a second threshold circuit 44' in the manner illustrated in broken lines in FIG. 4 the arrangement of FIG. 7 can also be adapted to effect release during a backward fall. The threshold circuit 44' has a threshold the sign of which is again reversed relative to that of the circuit 44.

The embodiment of FIG. 8 is distinguished from that of FIG. 6 in that the sole plate is divided into two parts 24', 24'' of which one is mounted on the ski 13 in the region of ball of the ski boot and the other is mounted on the ski at the heel region above the measuring transducers 12, 14 and 15. The boot retaining system 22 also consists of respective clamp pairs arranged on the plates 24', 24'' and pivotable sideways away from the ski boot. Two actuation devices A are fed from a common processing circuit 17. The front clamp pair can engage via elongate slots 27 on side journals 25 of the ski boot in order to ensure a certain degree of longitudinal movement of the boot inside the clamps at this region and thus to guarantee the loading of the longitudinal force measuring transducer 15.

FIGS. 9 to 12 show a particularly practical embodiment of the invention with electrical release.

The boot 20 is fastened by its sole 19 to the sole plate 24 which is in turn journalled on a plate 26 mounted on the ski via pivot bolt 25. The pivot bolt 25 is located at right angles to the ski beneath the section 11 which is in danger of breaking. The pivot bolt, by virtue of its support in an elongate slot 27, not only allows tilting of the plate 24 relative to the fixed plate 26 about the bolt axis but also a small movement of the sole plate 24 relative to the fixed plate 26 in the longitudinal direction of the ski. This is necessary in order to measure the longitudinal force F2 as required by the invention.

The force F1 which is to be measured in accordance with the invention is measured at the end of the plate through a cantilevered support 28 by means of a strain gauge 21. The cantilevered support 28 is fastened at one side to the housing 29 which is fixedly mounted to the ski and is pivotally connected at its other end with the sole plate 24.

The longitudinal force F2 is detected via a vertically directed cantilever 30 which carries a further strain gauge 21. The vertical cantilevered support 30 is likewise fastened to the housing 29 and engages pivotally from above in a recess in the sole plate 24.

The signals of the two strain gauges 21 are passed to the processing circuit 17 which is preferably likewise housed inside the housing 29.

The output line 31 of the processing circuit 17 passes in accordance with FIGS. 9 and 12 to an actuation magnet A which operates, via a toggle lever linkage 32, on the boot retaining system 22 in such a way that when the threshold provided in the processing circuit is exceeded the magnet A receives sufficient current to generate the force necessary to open the binding.

FIG. 9 also shows that the torsional loads on the leg can be measured in the same manner. A measuring transducer 33 which is in engagement with the sole plate 24 and is likewise arranged in the housing 29 delivers, in analog manner, an output signal proportional to the torsional force. This output signal is passed to the processing circuit 17. Pivotal movement of the plate 24 about the vertical axis 16' is made possible by the special construction of the bearing parts 25, 27.

I claim:

1. A ski safety binding adapted to determine the occurrence of a dangerous bending moment at a skier's leg about a transverse axis passing through substantially the weakest point of the skier's leg, said point being in the general vicinity of the uppermost portion of a ski boot secured via its sole to the ski by the binding, and for forming a release signal when said dangerous bending moment is approached, said safety binding comprising a ski boot securing system; actuating means for releasing said ski boot securing system in response to said release signal; a first measuring transducer arranged between the ski and the sole of the ski boot at a distance (Y) in the longitudinal direction of the ski behind the transverse axis for measuring a first force acting at said distance (Y) on the sole of the ski boot; a second measuring transducer arranged between the ski and the sole of the ski boot at a distance (Z) below said transverse axis and operative in the longitudinal direction of the ski to measure a second force acting in said direction on the sole of the ski boot; a third measuring transducer arranged between the ski and the sole of the ski boot at a distance (X) in the longitudinal direction of the ski in front of the transverse axis for measuring a third force acting at said distance (X) on the sole of the ski boot; and a processing circuit for receiving outputs from said first, second and third measuring transducers and for forming said release signal from the net moment of said first, second and third forces about said transverse axis.

2. A ski safety binding in accordance with claim 1 wherein the distance (Y) of the first measuring transducer behind said transverse axis is the same as the distance (X) of said third measuring transducer in front of said transverse axis.

3. A ski safety binding in accordance with claim 2 wherein said processing circuit forms said release signal from the sum of the outputs of said first and third measuring transducers reduced by the output of said second measuring transducer multiplied by a factor (Z/X) proportional directly to the distance (Z) of the transverse axis above the point at which said second force acts on the sole of the ski boot and inversely to the distance (X) of this point in front of the transverse axis.

4. A ski safety binding in accordance with claim 1 wherein the second measuring transducer is formed as a pressure transducer and is arranged between the front of the sole of the ski boot and a toe unit of the binding.

5. A ski safety binding in accordance with claim 1 wherein the first measuring transducer is subdivided into first and second pressure measuring transducers for producing respective output signals related to the forces which act downwardly and upwardly on the sole of the ski boot, and wherein the output signal of the second pressure measuring transducer for the upwardly directed force is negated and added to the output signal of said first pressure measuring transducer for the upwardly directed force.

6. A ski safety binding in accordance with claim 5 wherein said binding includes a sole clamp pivotable away from the sole in a rearward direction, said sole clamp having a sole retaining member and a pedal, and wherein said first pressure measuring transducer for the downwardly directed force is positioned to act between an upper side of said sole and said sole retaining member, and said second pressure measuring transducer is positioned between a lower side of said sole and said pedal.

7. A ski safety binding in accordance with claim 1 wherein at least one sole plate is inserted between the sole of the ski boot and the measuring transducers.

8. A ski safety binding in accordance with claim 7 wherein said sole plate is fixedly connected with said ski via the measuring transducers and carries the boot securing system.

9. A ski safety binding in accordance with claim 8 wherein said sole plate also carries the actuation means and the processing circuit.

10. A ski safety binding in accordance with claim 7 wherein said sole plate is continuous.

11. A ski safety binding in accordance with claim 10 wherein the sole plate is also pivotable to a minor degree about a vertical axis extending through the transverse axis against spring force, and wherein the boot securing system is also released by a pivotal movement of this kind.

12. A ski safety binding in accordance with claim 7 wherein separate front and rear sole plates are provided.

13. A ski safety binding in accordance with claim 12 wherein said front sole plate is associated with said third measuring transducer, and said rear sole plate is associated with said first measuring transducer.

14. A ski safety binding in accordance with claim 7 wherein at least one of said measuring transducers is constructed as a push-pull measuring transducer.

15. A ski safety binding in accordance with claim 1 wherein strain gauges are used for said measuring transducers with said strain gauges being attached to the parts of the binding transmitting said forces and being connected to said processing circuit.

16. A ski safety binding adapted to determine the occurrence of a dangerous bending moment at a skier's leg about a transverse axis passing through substantially the weakest point of the skier's leg, said point being in the general vicinity of the uppermost portion of a ski boot secured via its sole to the ski by the binding, and for forming a release signal when said dangerous bending moment is approached, said ski safety binding comprising a ski boot securing system; actuation means for releasing said ski boot securing system in response to said release signal; a first measuring transducer arranged between the ski and the sole of the ski boot at a distance (Y) in the longitudinal direction of the ski behind the transverse axis for measuring a first force acting at said distance (Y) on the sole of the ski boot; a second measuring transducer arranged between the ski and the sole of the ski boot at a distance (Z) below said transverse axis and operative in the longitudinal direction of the ski to measure a second force acting in said longitudinal direction on the sole of the ski boot; a support part for the sole of the ski boot; said support part being fixed to the ski and permitting a small degree of pivoting of the ski boot about at least a cross axis lying in the region of the underside of said ski boot, and wherein output signals of the first and second measuring transducers are applied to a processing circuit which forms the release signal from said output signals.

17. A ski safety binding in accordance with claim 16 wherein the processing circuit forms the release signal from the output signal of the first measuring transducer reduced by the output signal of the second measuring transducer multiplied by a factor (Z/Y) which is directly proportional to the distance (Z) of the transverse axis above said second measuring transducer and inversely proportional to the distance (Y) of the first measuring transducer in front of or behind the transverse axis.

18. A ski safety binding in accordance with claim 16 wherein the second measuring transducer is formed as a pressure transducer and is arranged between the front of the sole of the ski boot and a toe unit of the binding.

19. A ski safety binding in accordance with claim 18 wherein at least one sole plate is inserted between the sole of the ski boot and the measuring transducers.

20. A ski safety binding in accordance with claim 19 wherein said sole plate is fixedly connected with said ski via the measuring transducers and carries the boot securing system.

21. A ski safety binding in accordance with claim 19 wherein said sole plate also carries the actuation means and the processing circuit.

22. A ski safety binding in accordance with claim 19 wherein the sole plate is pivotally connected to the ski in the region of the associated cross axis.

23. A ski safety binding in accordance with claim 19 wherein the sole plate is continuous.

24. A ski safety binding in accordance with claim 19 wherein at least one of said measuring transducers is constructed as a push-pull measuring transducer.

25. A ski safety binding in accordance with claim 19 wherein the sole plate is also pivotable to a minor degree about a vertical axis extending through the transverse axis against spring force, and wherein the boot securing system is also released by a pivotal movement of this kind.

26. A ski safety binding in accordance with claim 16 wherein the first measuring transducer is subdivided into first and second pressure measuring transducers for producing respective output signals related to the forces which act upwardly and downwardly on the sole of the ski boot, and wherein the output signal of the second pressure measuring transducer for the upwardly directed force is negated and added to the output signal of said first pressure measuring transducer for the upwardly directed force.

27. A ski safety binding in accordance with claim 26 wherein said binding includes a sole clamp pivotable away from the sole in a rearward direction, said sole clamp having a sole retaining member and a pedal and wherein said first pressure measuring transducer for the downwardly directed force is positioned to act between an upper side of said sole and said sole retaining member, and said second pressure measuring transducer is positioned between a lower side of said sole and said pedal.

28. A ski safety binding in accordance with claim 16 wherein strain gauges are used for said measuring transducers with said strain gauges being attached to the parts of the binding transmitting said forces and being connected to said processing circuit.

29. A ski safety binding with a measuring system for determining the occurrence of a dangerous bending moment about a transverse axis through the most endangered point of a skier's leg, said point being located somewhere above the skier's ankle, said ski safety binding comprising means for securing a skier's boot to a ski; first force transducing means arranged near the heel region of the ski boot to measure the force prevailing between the ski boot and the ski in a vertical direction relative to the ski, second force transducing means arranged near the toe region of the ski boot to measure the force prevailing between the ski boot and the ski in the longitudinal direction of the ski; third force transducing means arranged at the forward portion of the ski boot forward of a vertical plane through said most endangered point to measure the prevailing vertically directed force on the ski boot at said point, and support means for the ski boot lying in said vertical plane, processing circuit means for receiving signals from said pressure transducing means and for computing a signal representative of said bending moment from said signals and the geometry of the binding relative to said most endangered point, and release means for releasing said binding means when the bending moment computed by said processing circuit means reaches a dangerous level.

* * * * *